US005570556A

United States Patent [19]

Wagner

[11] Patent Number: 5,570,556

[45] Date of Patent: Nov. 5, 1996

[54] SHINGLES WITH CONNECTORS

[76] Inventor: Thomas E. Wagner, P.O. Box 422, Rolla, Mo. 65401

[21] Appl. No.: 321,783

[22] Filed: Oct. 12, 1994

[51] Int. Cl.[6] ..... F04D 1/26

[52] U.S. Cl. ..... 52/552; 52/518; 52/528; 52/545

[58] Field of Search ..... 52/408, 410, 518, 52/520, 521, 522, 526, 527, 528, 543, 545, 552; 160/229.1, 231.1

[56] References Cited

U.S. PATENT DOCUMENTS

| | | | |
|---|---|---|---|
| D. 338,635 | 8/1993 | Spindler et al. . | |
| 1,944,696 | 1/1934 | Reichl | 160/231.1 |
| 3,082,577 | 3/1963 | Fasold et al. | 52/543 |
| 3,245,192 | 4/1966 | Hilson | 52/748.1 X |
| 3,640,044 | 2/1972 | Watts . | |
| 3,894,376 | 7/1975 | Shearer | 52/545 X |
| 4,202,396 | 5/1980 | Levy | 160/229.1 X |
| 4,322,928 | 4/1982 | Freiborg | 52/545 X |
| 4,404,783 | 9/1983 | Freiborg | 52/518 |
| 4,491,166 | 1/1985 | Hanna | 160/229.1 X |
| 4,672,790 | 6/1987 | Frieborg | 52/545 X |
| 5,037,685 | 8/1991 | Richards et al. | 52/518 X |
| 5,052,162 | 10/1991 | Bush et al. . | |
| 5,102,487 | 4/1992 | Lamb . | |
| 5,343,664 | 9/1994 | Loucks | 52/518 |

*Primary Examiner*—Carl D. Friedman
*Assistant Examiner*—Kevin D. Wilkens
*Attorney, Agent, or Firm*—Richard J. Grundstrom

[57] ABSTRACT

Shingles with connectors consist of typical or standard roofing shingles joined together with connectors to form a row of shingle. The shingles are generally rectangular in shape with a top surface, bottom surface, top edge, bottom edge, a right edge and a left edge. The connectors are alternatively attached to the left and right edges of the shingles. The connectors act as hinges such that a specific number of shingles can be folded to form a bundle. Once the first shingle of the bundle is placed, the bundle is unfolded to form a row of shingles in proper position on a roof for attachment, thereby eliminating the need to place and position each individual shingle.

7 Claims, 4 Drawing Sheets

SHINGLES WITH CONNECTORS

The present invention relates to roofing shingles and more particularly to shingles with connectors.

Roofing shingles have been in use for many years and are well known in the roofing industry. Roofing shingles are basically used to waterproof the roof of a building to protect the interior from rain. Roofing shingles are made from many different types of materials. The most common is asphalt and fiberglass based. Wood shingles are also commonly used and known.

In the typical installation, the shingles are laid one at a time row after row, or in alterations thereof. The singles are typically installed and attached one at a time by the roofer. The first row of shingles is usually located along the lower edge of the roof. Rows of overlapping shingles are then installed one shingle at a time. Shingles are typically of a uniform size for a particular job. The position of the overlapping rows can be altered to produce different patterns on the roof.

There are shingles available that produce a varied roof shingle pattern by varying the pattern of cutouts and tabs. The tabs and cutouts of the shingle are left exposed when the roof is shingled. Examples of these shingles are described in U.S. Pat. No. 5,102,487 by Lamb and U.S. Pat. No. 5,052,162 by Bush et al. These patents describe method of producing shingle having varied tabs and cutouts that can be used to produce distinctive roof patterns. These shingles still have to be laid one shingle at a time.

Since shingles have to be installed one at a time, a roofer largest expenditure of time is the placement and attachment of each individual shingle. Watts in U.S. Pat. No. 3,640,044 addressed this problem by revealing a panel of prefabricated shingles. Each panel consisted of several courses or rows of shingles attached to form a panel. It is believed that shipment to the work site and handling of panels by workers was burdensome, and the placement, alignment and the attachment of sequential panels by the roofer were not easily done. The panels were never widely accepted.

Attachment of shingles to the roof, the second most time consuming task of the roofer, is typically by roofing nails or roofing staples. There have been many advancements in this area to decrease the amount of time the roofer spends attaching shingles. The roofer has available air or electric nailers and automatic staplers just to name the most common. There are several other advancements for the attachment of shingles to the roof.

The placement and alignment of shingles is probably the largest time consuming task for a roofer. This invention is directly concerned with and addresses the problem of placement and alignment of shingles.

Accordingly, it is an object of the present invention to provide shingles with connectors that provide a means of rapidly placing rows of shingles. It has been found that there is a substantial savings of time in the placement of rows of shingles using the shingles with connectors of this invention.

Another object of the present invention is to provide shingles with connectors constructed so that the roofer can easily handle a bundle of shingles without additional help or equipment.

A further object of the present invention is to provide shingles with connectors adapted for easy packaging, for storage, shipment and handling, to substantially increase the acceptance of shingles with connectors.

Still another object of the present invention is to provide shingles with connectors that may be folded one over the other for bundling and for unfolding on the roof.

Still a further object of the present invention is to provide shingles with connectors that are relatively easy to manufacture for keeping cost to a minimum and to provide an affordable shingle for the owner of the roof.

SUMMARY OF THE INVENTION

To accomplish the foregoing and other objects of this invention there is provided shingles with connectors and more particularly to roofing shingles connected at the outer edges with connectors that allow the shingle to be folded one over the other.

The shingles are typically similar to those known in the art and in the field of roofing. The shingles are generally Rectangular with a top surface, bottom surface, top edge, bottom edge, a right edge and a left edge. The connectors are a semi-flexible material that attaches to the left and right edges of the shingles. The joined shingles form a row of shingles joined at the edges. Each connector forms a hinge between the shingles such that the shingles can be folded one over another to form a bundle. The first shingle of the bundle is properly positioned on a roof for attachment. Once the first shingle is placed, the remaining shingles in the bundle can be unfolded to form a row of shingles all of which are properly positioned and aligned for attachment.

In operation, the shingles are joined with the connectors, usually at the factory where they are manufactured. The shingles are alternately folded in a ⅓ square as they come off the assembly line and wrapped for shipment. At location, the stack or bundle of shingles is placed in a proper position where the first shingle is placed for attachment to the roof. The shingles are than unfolded and pulled across the roof for attachment. The connector acts as a hinge for the unfolding stack of shingles and holds the shingles in alignment for attachment to the roof. As long as the first shingle is properly placed, all the unfolding shingle will be properly aligned for attachment.

The above mentioned and other objects and features of the present invention will be better understood and appreciated from the following detailed description of the main embodiment thereof, selected for purposes of illustration and shown in the accompanying drawings.

DETAILED DESCRIPTION

Figure 1:
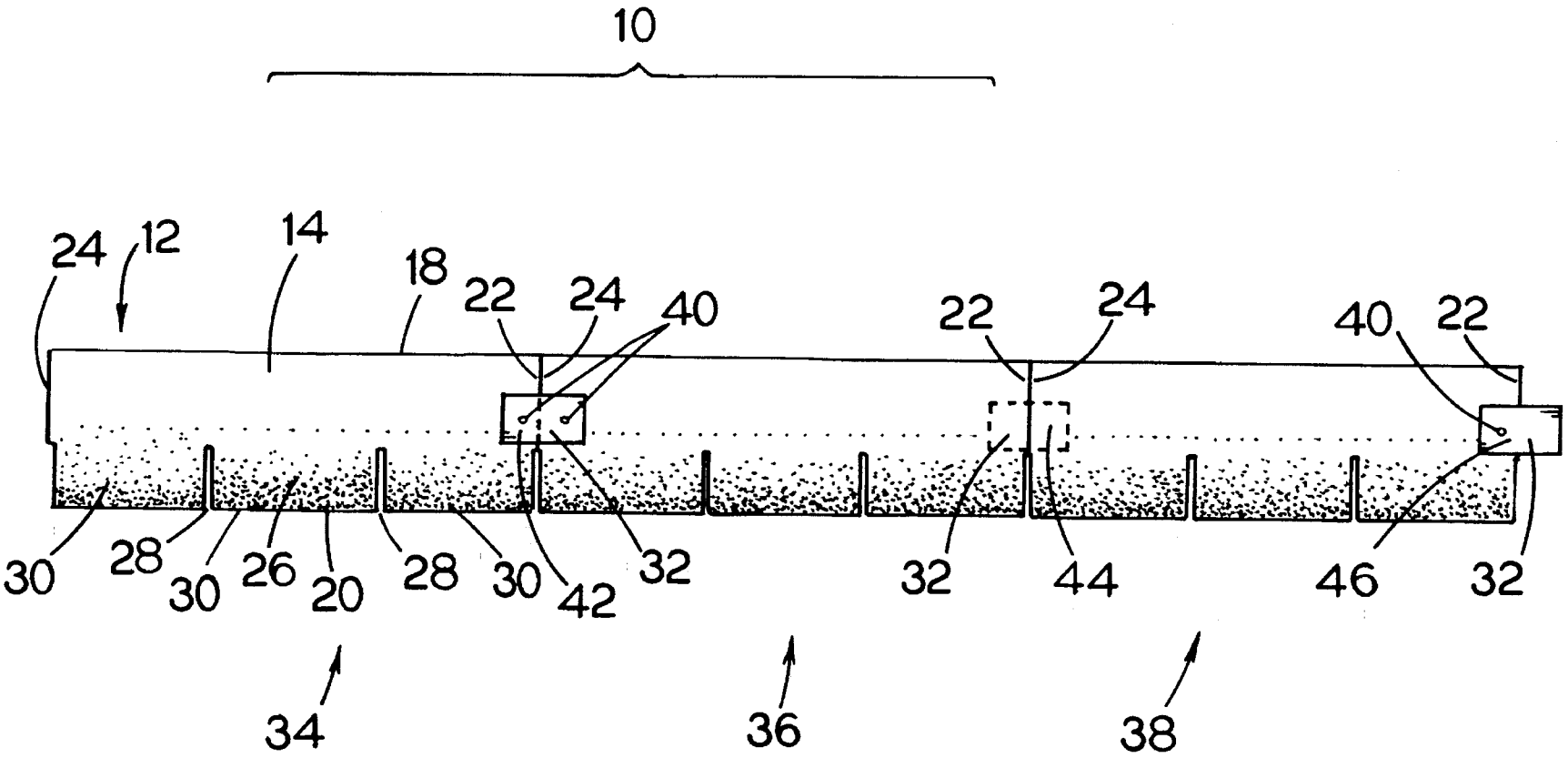
FIG. 1 is a top view of the shingles with connectors.

Referring now to the drawings in general there is shown one preferred embodiment for the shingles with connectors 10 of this invention.

The preferred embodiment and the best mode contemplated of the shingles with connectors 10 of the present invention are herein described. However, it should be understood that the best mode for carrying out the invention hereinafter described is offered by way of illustration and not by the way of limitation. It is intended that the scope of the invention includes all modifications that incorporate its principal design features.

The shingles 12, in the preferred embodiment of this invention, are typical or standard shingles 12 well known in the art. The shingles 12 are typically asphalt or fiberglass based with a granular material 26 on the portion of top surface 14 that is left exposed. The shingles 12 usually have cutouts 28 and tabs 30 on the bottom portion that contains the granular material 26. The cutouts 28 and tabs 30 provide a pattern on the roof. Besides being for aesthetics, the pattern also functions in directing water off a roof.

The most common shingle 12, referring to FIG. 1, is generally rectangular with a top surface 14, bottom surface 16, top edge 18, bottom edge 20, a right edge 22 and a left edge 24. The shingle 12 is approximately 3 feet long and 1 foot wide. 6 to 8 inches of the lower portion of the top surface 14 is usually covered with a granular material 26. Extending inward from the bottom edge are two cutouts 28 that divides the length into three tabs 30. Each tab 30 is approximately 1 foot wide. The cutouts 28 extend inward approximately 6 inches.

In the typical installation of a standard shingle 12, a row, or if working in smaller areas a portion of a row, is started at the lower edge of a roof. The shingles 12 are aligned left edge 24 to right edge 22, and vice versa, one at a time to form a row. As each shingle 12 is laid and positioned it is attached to the roof by nails or staples. The next layer or course of shingles 12 overlaps the first row of shingles 12. The second course or row overlaps the first row down to the tip of the cutouts 28. This leaves only the tabs 30 having the granular material 26 exposed. The arrangement and positioning of the overlapping tabs 30 and cutouts 28 forms a pattern on the roof. The pattern can be varied for aesthetics and for directing water flow. A major portion of time a roofer expends is on the placement and alignment of the shingles 12 for attachment.

Figure 2:
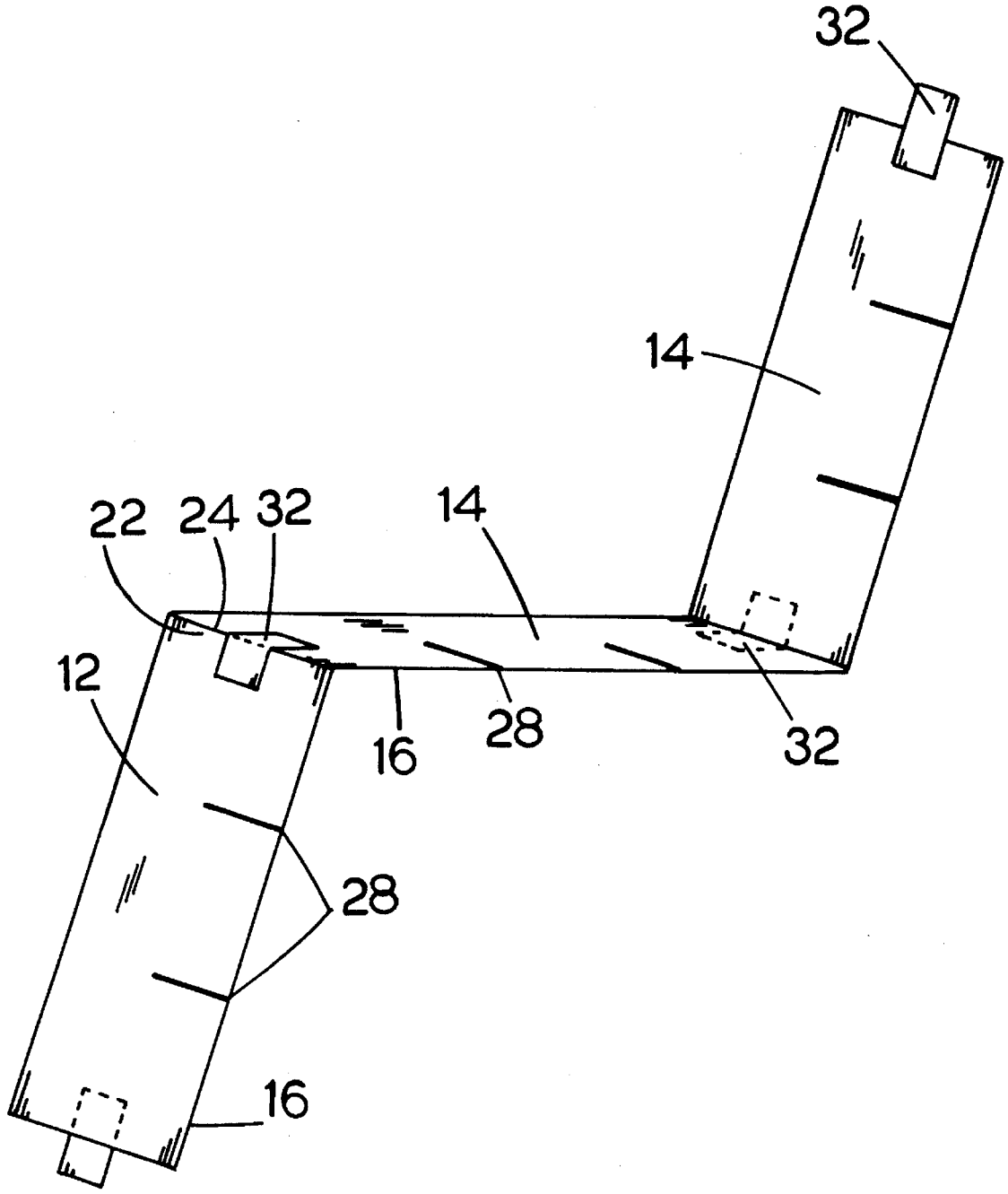
FIG. 2 is an isometric view of shingles with connectors showing three shingles in a partial folded position.
Figure 3:
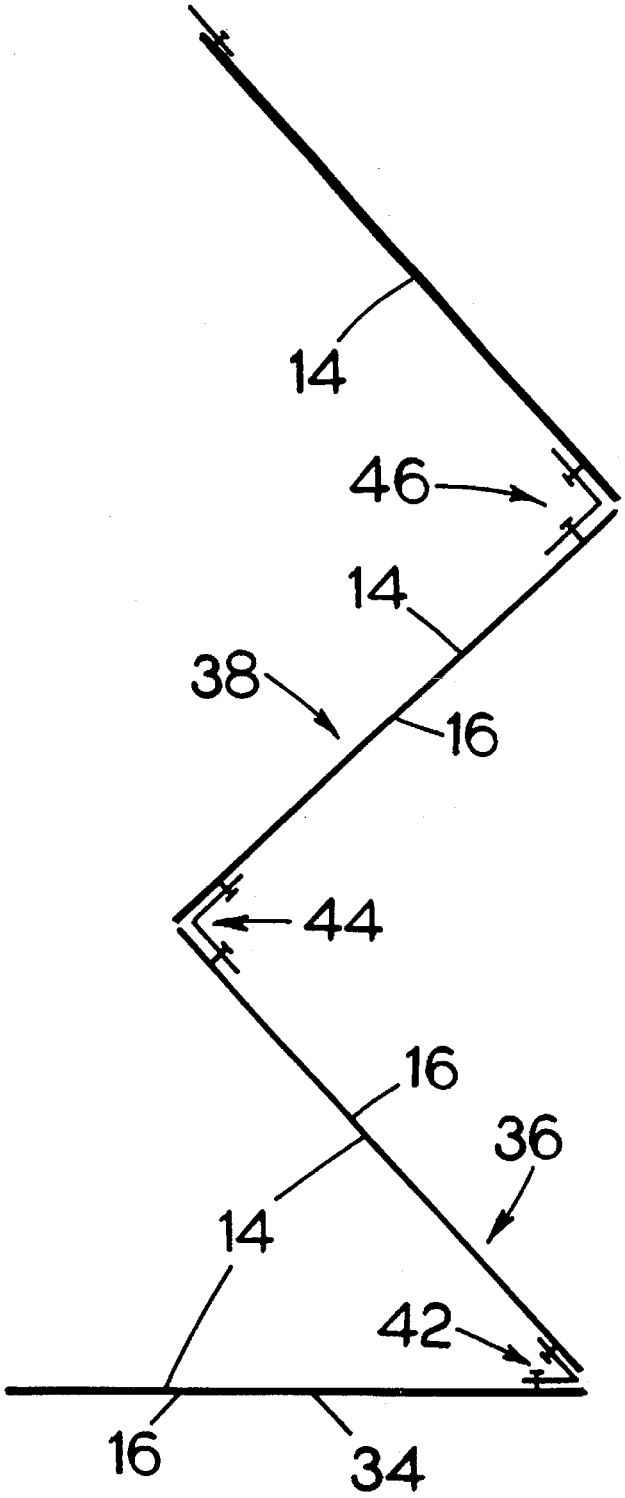
FIG. 3 is a side view of shingles with connectors showing four shingles being folded.
Figure 4:
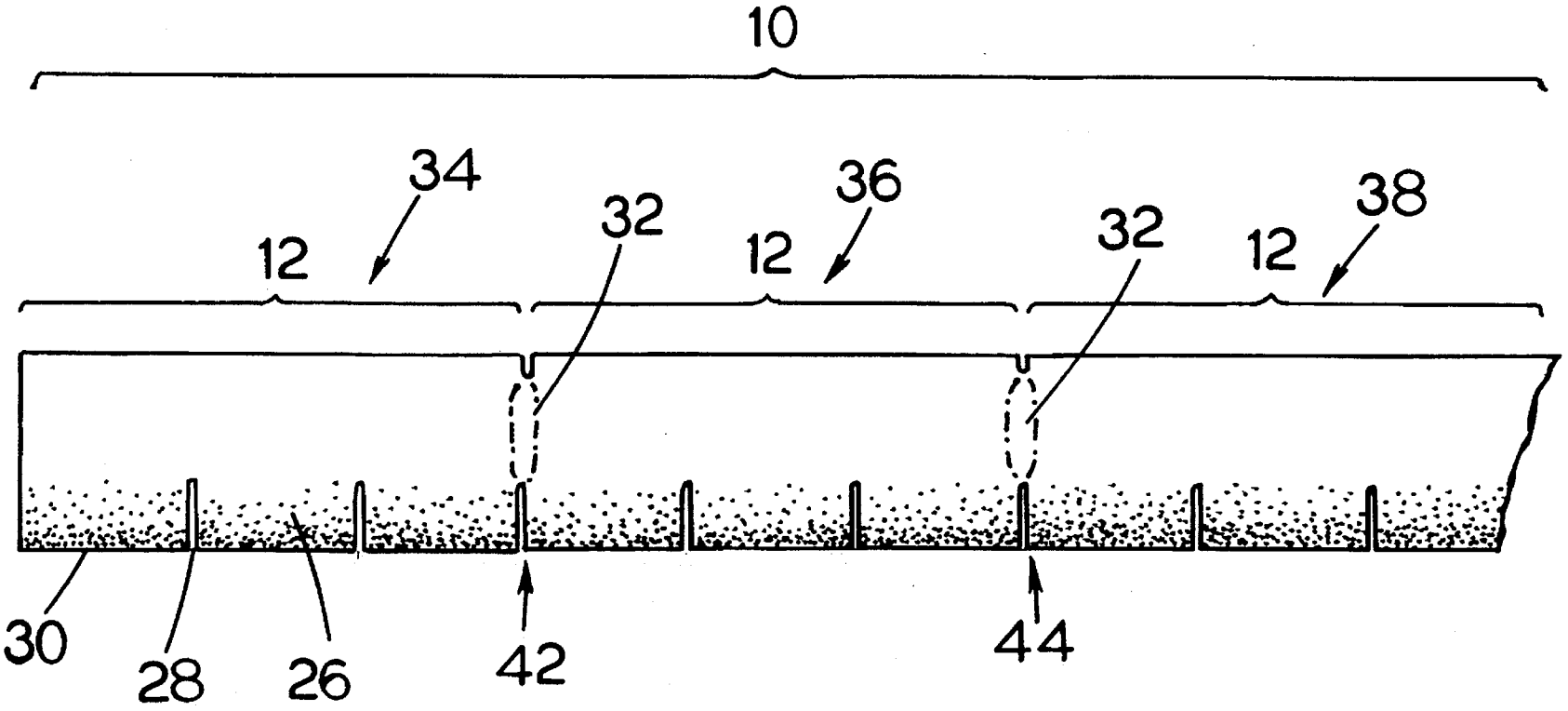
FIG. 4 is a view representing shingles with connectors impregnated within and continuous with the base material of the shingles.

The shingles 20 of this invention include connectors 32. The connectors 32 join the right edge 22 of one shingle to the left edge 24 of the next shingle. A series of shingles 12 so joined forms a row of shingles 12. The connector 32 acts as a hinge such that the shingles 12 can be folded one over the other, as illustrated in FIGS. 2 and 3. The connector 32 also holds the shingles 12 in alignment as they are unfolded. In this manner, the first shingle 34 is placed for attachment. The remaining shingles 12 in the bundle are unfolded to form a row for attachment. If the first shingle 34 is properly positioned, the remaining shingles 12 will be unfolded in alignment and in a proper position for attachment. The greatest expenditure of time is the placement and alignment of individual shingles 12. The shingles with connectors 10 greatly reduces this time.

Connectors 32 are typically made from a semi-flexible material. The material may be identical to the base material of the shingle 12, other roofing material or may be of other material that allows greater flexibility. The purpose of the connector 32 is to provide a hinge between the shingles 12 so that they may fold one over another and rigidly hold the joined shingles 12 in alignment as they are unfolded and placed for attachment. Therefore, the material selected must be flexible enough to provide the "hinge" between the shingles 12, strong enough that it will not break when unfolded and be rigid enough to hold adjacent shingle 12 in proper alignment. Asphalt roofing paper has been satisfactory used as connectors 32, but other materials may be used without departing from the spirit and scope of the inventive concepts herein disclosed.

The connectors 32, in the preferred embodiment illustrated, are made independent from the shingles 12 and attached by an adhesive, staples, fasteners 40 (as illustrated) or by other acceptable means or combinations. The connectors 32, in another embodiment, may be impregnated within and made continuous with the base material of which the shingles 12 are made. In this embodiment, the connectors 32 would be made continuous with the shingles as they are manufactured.

The shingles 12, referring to FIG. 1, 2 and 3 in one embodiment as illustrated, can be generally referred to as the first shingle 34, second shingle 36, third shingle 38 and continuing on to the last shingle. The connectors 32, in the embodiment as illustrated, are generally referred to as first connector 42, second connector 44, third connector 46 and so forth to a last connector. Half of the first connector 42 is attached along the right edge 22 of the top surface 14 of the first shingle 34. The second half of the first connector 42 is attached along the left edge 24 of the top surface 14 of the second shingle 36. The first connector 42 allows the second shingle 36 to fold over on top of the first shingle 34 such that the top surfaces 14 of the first and second shingles 34 and 36 are together.

Half of the second connector 44 is attached to the bottom surface 16 along the right edge 22 of the second shingle 36, similar to the first connector 42. The other half of the second connector 44 is attached to the bottom surface 16 along the left edge 24 of the third shingle 38. The second connector 36 allows the third shingle 38 to fold onto the second shingle 36 such that the bottom surfaces 16 of the second and third shingles 36 and 38 are together.

The third connector 46 joins the third shingle 38 and a fourth shingle in the same manner as the first connector 42. The connector 32 will be attached to the top surface 14 such that the top surfaces 14 are joined when folded. A fourth connector joins the fourth shingle and a fifth shingle in the same manner as the second connector. The connector 32 would be attached to the bottom surface 16 such that the bottom surfaces 16 are joined when folded. This pattern is repeated to the last shingle.

The shingles 12 would be folded to form a ⅓ square bundle, which is standard in the industry and is easily handled by a roofer. One square of shingles, using typical shingles 12, cover 100 square feet of surface area. Approximately 22 shingles 12 are included in a bundle of ⅓ square.

In operation the shingles 12 are joined with the connectors at the factory where they are manufactured. The shingles 12 are alternately folded in a ⅓ square as they come off the assembly line and wrapped for shipment. At location, the stack of shingles 12 is placed in a proper position where the first shingle 12 is placed for attachment to the roof. The shingles are than unfolded and pulled across the roof for attachment. The connector 32 acts as a hinge for the unfolding stack of shingles 12 and holds the shingles 12 in alignment for attachment to the roof. As long as the first shingle is properly placed, all the unfolding shingle will be properly aligned for attachment.

Having described the invention in detail, those skilled in the art will appreciate that modifications may be made of the invention without departing from the spirit of the inventive concept herein described.

Therefore, it is not intended that the scope of the invention is limited to the specific and preferred embodiments illustrated and described. Rather, it is intended that the scope of the invention is determined by the appended claims and their equivalents.

What is claimed is:

1. Shingles with connectors comprising:

a plurality of individual roofing shingles having tabs and cutouts, each shingle being generally rectangular with a top surface having a granular surface on the lower portion, a bottom surface, top edge, bottom edge, a right edge and a left edge; and a plurality of connectors permanently attached to said left and right edges of said shingles to form a row of joined shingles, said connectors being impregnated within and continuous with a base material of which said shingles are made, each of said connectors forming a hinge between said shingles, such that said shingles can be folded one over another to form a bundle, said connectors rigidly holding said shingles in alignment as said shingles are unfolded and placed for attachment on the roof to be shingled.

2. Shingles with connectors comprising:

a plurality of individual roofing shingles having tabs and cutouts generally referred to as a first shingle, second shingle, third shingle and continuing to a last shingle, each shingle being generally rectangular in shape with a top surface having a granular surface on the lower portion, bottom surface, top edge, bottom edge, a right edge and a left edge; and a plurality of connectors generally referred to as first connector, second connector, third connector and so forth to a last connector, each connector comprising a piece of semi-flexible material providing a hinge between said shingles, a first half of said first connector being attached to said top surface of said first shingle along said right edge, a second half of said first connector attached to said top surface along said left edge of said second shingle, said first connector allowing said second shingle to fold over on top of said first shingle such that said top surfaces of said shingle are together; a first half of said second connector attached to said bottom surface along said right edge of said second shingle, a second half of said second connector attached to said bottom surface along said left edge of said third shingle, said second connector allowing said third shingle to fold onto said second shingle such that said bottom surfaces of said second and third shingles are together; said third connector joining said third and a fourth shingle in the same manner as said first connector; said fourth connector joining said fourth and a fifth shingle in the same manner as said second connector; and alternatively repeating to said last connector and said last shingle.

3. The shingles with connectors as set forth in claim 2 in which said connectors comprise pieces of semi-flexible material to provide a hinge between said shingles.

4. The shingles with connectors as set forth in claim 2 in which said connectors are permanently attached to said shingles by an adhesive.

5. The shingles with connectors as set forth in claim 2 in which said connectors are permanently attached to said shingles by staples.

6. The shingles with connectors as set forth in claim 2 in which a first shingle of said bundle is properly positioned for attachment on the roof to be shingled and remaining shingles in said bundle are unfolded to form a row of shingles all of which are properly positioned for attachment.

7. Shingles with connectors comprising:

a plurality of individual roofing shingles having a top surface, bottom surface, right outer edge, and left outer edge; and a plurality of connectors joining said plurality of shingles at outer edges of said shingles such that said shingles can be folded one over another to form a bundle, said connectors are generally referred to as first connector, second connector, third connector and so forth to a last connector, a first half of said first connector being attached to said top surface of a first shingle along said right edge, a second half of said first connector attached to said top surface along said left edge of a second shingle, said first connector allowing said second shingle to fold over on top of said first shingle such that said top surfaces of said first and second shingles are together; a first half of said second connector attached to said bottom surface along said right edge of said second shingle, a second half of said second connector attached to said bottom surface along said left edge of a third shingle, said second connector allowing said third shingle to fold onto said second shingle such that said bottom surfaces of said second and third shingles are together; said third connector joining said third shingle and a fourth shingle in the same manner as said first connector; a fourth connector joining a fourth shingle and a fifth shingle in the same manner as said second connector; and alternatively repeating to a last connector and a last shingle, said shingles being unfolded after a first shingle of said bundle is properly placed for attachment on the roof to be shingled, said shingles being unfolded forming a row of shingles properly positioned for attachment.

* * * * *